United States Patent [19]

Fast

[11] Patent Number: 4,760,660

[45] Date of Patent: Aug. 2, 1988

[54] LABEL HOLDER FOR USE WITH WIRE ROD-TYPE STRUCTURES

[76] Inventor: Jacob Fast, 7561 NW. 9th St., Plantation, Fla. 33317

[21] Appl. No.: 5,910

[22] Filed: Jan. 21, 1987

[51] Int. Cl.[4] ..... G09F 3/00

[52] U.S. Cl. ..... 40/308; 40/316; 40/658

[58] Field of Search ..... 40/308, 316, 21 R, 19.5, 40/606, 539

[56] References Cited

U.S. PATENT DOCUMENTS

| | | | |
|---|---|---|---|
| 1,832,318 | 11/1931 | Myers | 40/21 R |
| 2,248,145 | 7/1941 | Wilder | 40/21 R |
| 3,423,861 | 1/1969 | Forsyth | 40/310 |
| 4,379,372 | 4/1983 | Alexander et al. | 40/316 |
| 4,539,767 | 9/1985 | Jaffe | 40/316 |

FOREIGN PATENT DOCUMENTS

| | | | |
|---|---|---|---|
| 873434 | 7/1942 | France | 40/316 |
| 735209 | 8/1955 | United Kingdom | 40/308 |

*Primary Examiner*—Robert Peshock
*Assistant Examiner*—Cary E. Stone
*Attorney, Agent, or Firm*—Holman & Stern

[57] ABSTRACT

A label holder of plastic sheet material is particularly adapted for use on wire rod structures having a horizontal wire rod and one or more vertical wire rods depending from the horizontal rod. The label holder has a central label panel and upper and lower attachment portions. Each attachment portion has a tab with a rod-engaging aperture and slit. The upper attachment portion is folded over the top of the horizontal rod and its aperture is engaged with a vertical rod from behind. The aperture of the lower attachment portion is engaged with the vertical rod from the front. The angle of the label panel is set by adjusting the degree of folding between the label panel and the lower attachment portion.

5 Claims, 1 Drawing Sheet

LABEL HOLDER FOR USE WITH WIRE ROD-TYPE STRUCTURES

BACKGROUND AND SUMMARY OF THE INVENTION

This invention relates to label holders for use in providing product information and the like applicable to products displayed on wire rod-type structures, such as wire shelves, wire baskets, guard rails and the like.

It is an object of the invention to provide a novel label holder for the purpose indicated which is extremely versatile in its application to diverse wire rod-type structures, which is simple to apply and remove, which is firm and stable when applied, with minimum tendency to slide, and which is adjustable as to the angle at which is presents a label-displaying surface.

With the above and other objects in view, the invention provides a label holder for attachment to a wire rod structure comprising a card of stiffish plastic sheet material having an upper attachment portion, a lower attachment portion, a label panel between the upper and lower portions, respective transverse fold means separating the label panel from the upper and lower portions and a wire rod-gripping aperture and slit in each of the upper and lower portions, the slit extending from the respective aperture to a respective edge of the holder for engaging the aperture on a wire rod. The respective rod-gripping apertures and slits may, for example, be formed in respective tabs which extend from upper and lower edges of the holder.

The fold means between the label panel and the upper attachment portion of the holder may comprise a pair of transverse fold lines, and the fold means between the label holder and the lower attachment portion may comprise a single transverse fold line. This arrangement allows the upper portion of the holder to be folded over the back of a horizontal wire rod, for example at the top of a wire basket, shelf guard rail or the like, and attached from behind to a vertical wire rod of the structure below the horizontal rod, through the aperture and slit in the top portion, while the bottom portion of the holder is attached from the front to the vertical wire rod through the aperture and slit in the bottom portion. The double slit-and-aperture attachment of the holder to the wire structure provides stability of mounting, and the fold line between the lable panel and the bottom portion of the holder allows the angle of the label panel to be adjusted and set in a required position.

Additional features and advantages of the invention will become apparent from the ensuing description and claims read in conjunction with the attached drawings.

BRIEF DESCRIPTION OF DRAWINGS

FIG. 5 is a face view of the label holder as manufactured.

DESCRIPTION OF PREFERRED EMBODIMENT

Figure 1:
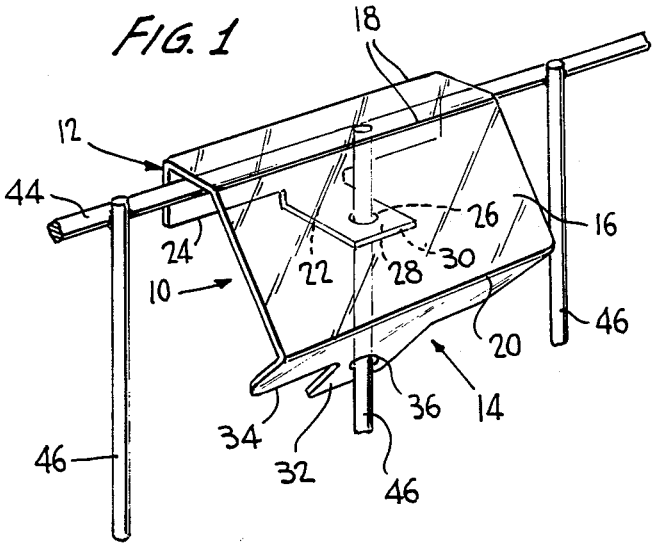
FIG. 1 is a perspective view of a label holder in accordance with the invention attached to a wire rod structure.
Figure 2:
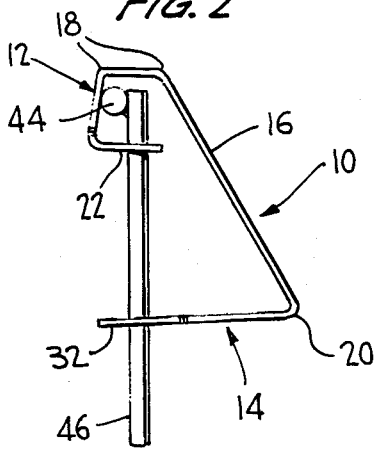
FIGS. 2 to 5 are side elevational views of the assembly shown in FIG. 1 with the label holder shown in different positions of adjustment in the respective figures.
Figure 3:
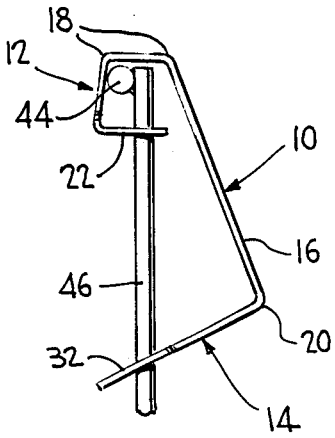
Figure 5:
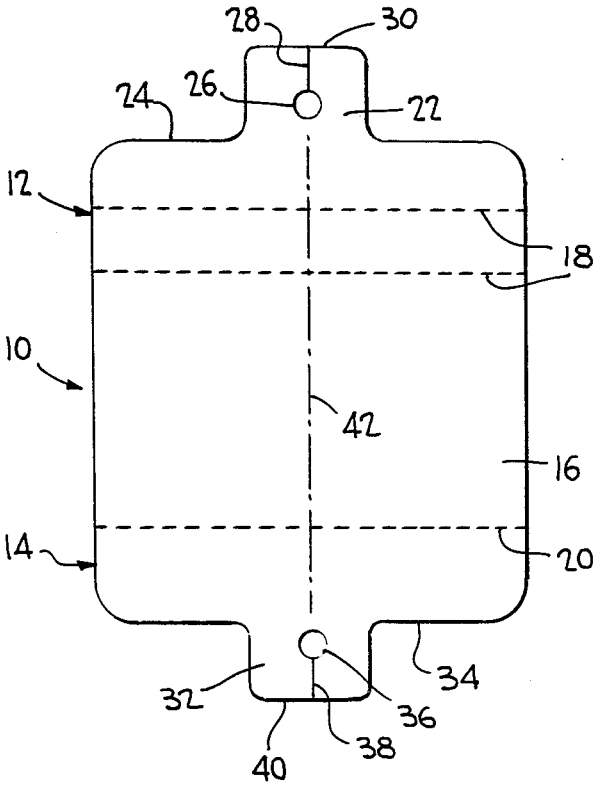
Figure 4:
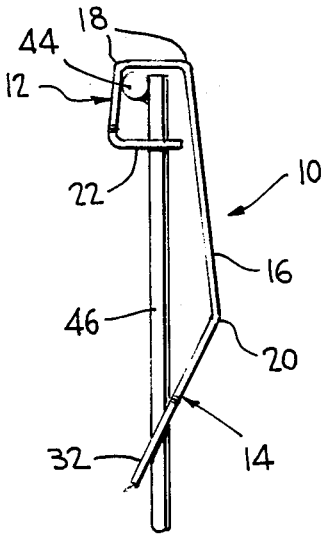

Referring initially to FIG. 5, there is shown a label holder in accordance with the invention in the form of a card 10 which may, for example to die-cut and formed from a sheet of stiffish plastic of a type well known for such purposes. The card is formed with an upper attachment portion 12, a lower attachment portion 14, and a label panel 16 therebetween. The label panel is separated from the upper attachment portion by a pair of transverse fold lines 18, and from the lower attachment portion by a single transverse fold line 20. Upper attachment portion 12 includes a tab 22 extending from upper edge 24 of the holder, and the tab is formed with a wire rod-engaging aperture 26 and slit 28 extending from the aperture to upper edge 30 of the tab. Similarly, the lower attachment portion 14 includes a tab 32 extending from lower edge 34 of the holder, and tab 32 is formed with a wire rod-engaging aperture 36 and slit 38 extending from the aperture to lower edge 40 of the tab. The apertures 26, 36 and slits 28, 38 preferably are all centered on longitudinal center line 42 of the holder.

The holder 10 shown in FIG. 5 is particularly suited for attachment to a wire rod structure of the type shown in FIGS. 1–4 which includes, for example a upper horizontal wire rod 44, and one or more vertical wire rods 46 welded to and depending from rod 44. Such structures may be found, for example, in wire baskets, wire shelf guard rails, J-hooks and the like.

In order to attach the holder 10 to the illustrated wire rod structure, the upper attachment portion 14 is folded over the back of rod 44 about fold lines 18, and aperture 26 which is adapted in size to fit rods 46, is engaged, through slit 28, on one of the rods 46 from behind. The lower aperture 36 is engaged on the rod 46 from the front, through slit 38, and the holder is then firmly and stably attached to the structure. Moreover, dependent on the degree of bending that the holder is set at about line 20 (see FIGS. 2 to 4) and hence the vertical positioning of aperture 36 on rod 46, the angle of label panel 16 is adjusted and set in a required position. Preferably the stiffness of the sheet material from which the holder is made is such that when it is bent about the respective fold line it will stay substantially in the folded position.

It will be evident that the holder may be readily attached to and detached from wire rod structures as described, and provides an adjustable and stable panel for an adhesive or like label.

While only a preferred embodiment of the invention has been described herein in detail, the invention is not limited thereby and modifications can be made within the scope of the attached claims.

What is claimed is:

1. A label holder for attachment to a wire rod structure, the holder comprising a card of sheet material having an upper attachment portion, a lower attachment portion, and a label panel between the upper and lower portions, transverse fold means separating the label panel from the respective upper and lower portions, and a wire rod-gripping aperture and slit in each of the upper and lower portions, the slit extending from the respective aperture to a respective edge of the holder for engaging the aperture on a wire rod wherein the fold means between the label panel and the upper attachment portion comprises a pair of transverse fold lines.

2. A label holder as defined in claim 1, wherein the upper and lower portions of the holder include respective tabs extending from upper and lower edges of the holder, and wherein the respective apertures and slits are formed in the tabs.

3. A label holder as defined in claim 2 wherein the apertures and slits are centered on a longitudinal center line of the holder.

4. A label holder as defined in claim 1 wherein the fold means between the label panel and the lower attachment portion comprises a single transverse fold line.

5. A label holder in combination with a wire rod structure, the label holder comprising a card of sheet material having an upper attachment portion, a lower attachment portion, and a label panel between the upper and lower portions, transverse fold means separating the label panel from the respective upper and lower portions, and a wire rod-gripping aperture and slit in each of the upper and lower portions, the slit extending from the respective aperture to a respective edge of the holder for engaging the aperture on a wire rod, the wire rod structure having a horizontal wire rod and at least one vertical wire rod depending from the horizontal rod wherein the upper attachment portion of the holder is folded over the horizontal rod, the aperture in the upper portion is engaged with the vertical rod from one side thereof, the aperture in the lower attachment portion is engaged with the vertical rod from an opposite side thereof, and the transverse fold means between the label panel and the lower attachment portion is set to establish a required angle for the label panel on said opposite side of the vertical rod.

* * * * *